United States Patent [19]

Sekera, Jr. et al.

[11] 4,052,591

[45] Oct. 4, 1977

[54] INFINITE SWITCH AND INDICATOR

[75] Inventors: George F. Sekera, Jr., Hinsdale; Otto J. Cousins, Burbank, both of Ill.

[73] Assignee: Harper-Wyman Company, Hinsdale, Ill.

[21] Appl. No.: 615,119

[22] Filed: Sept. 19, 1975

[51] Int. Cl.[2] ..... H05B 1/02; H01H 37/12

[52] U.S. Cl. ..... 219/506; 337/361

[58] Field of Search ..... 116/114.5; 122/504.2; 236/94; 219/109, 248, 269, 453, 487, 506; 200/11; 337/361, 305

[56] References Cited

U.S. PATENT DOCUMENTS

| | | | |
|---|---|---|---|
| 2,299,462 | 10/1942 | Clark et al. | 219/248 X |
| 2,462,594 | 2/1949 | Beal | 219/487 X |

FOREIGN PATENT DOCUMENTS

| | | | |
|---|---|---|---|
| 655,497 | 6/1963 | Italy | 337/305 |
| 1,147,837 | 4/1969 | United Kingdom | 219/487 |

*Primary Examiner*—J. V. Truhe
*Assistant Examiner*—Fred E. Bell
*Attorney, Agent, or Firm*—Mason, Kolehmainen, Rathburn & Wyss

[57] ABSTRACT

An infinite switch for controlling the temperature of a stove heating element is provided with a visual indicator energized when the heating element is energized. The switch has terminals connected to an electrical power source and includes a housing, a cover with a central aperture, and a rotatable, hollow spindle extending through the aperture and into the housing. A cam mounted on the spindle interacts with two sets of switch contact elements. One set of contact elements is movable by the cam from an open to a closed position thereby connecting the power source with the second set of contact elements. The second set of switch contact elements are adjusted by the cam and are operated by a thermomotive element in heat transfer relation with a thermal heating device. The thermomotive element cycles the second set of contacts between open and closed positions alternately to energize and deenergize the heating element. The proportion of on time during each cycle is determined by the position of the cam. A knob mounted on the spindle external to the housing has a central aperture, and a lamp is positioned within the housing and adjacent the hollow spindle. The lamp may be connected in a circuit with switch contacts and energized when the controlled heating element is energized. A light transmission element is positioned within the hollow spindle and extends from the lamp to the region of the knob to transmit light from the lamp through the hollow spindle to the aperture in the knob.

5 Claims, 13 Drawing Figures

Fig. 1
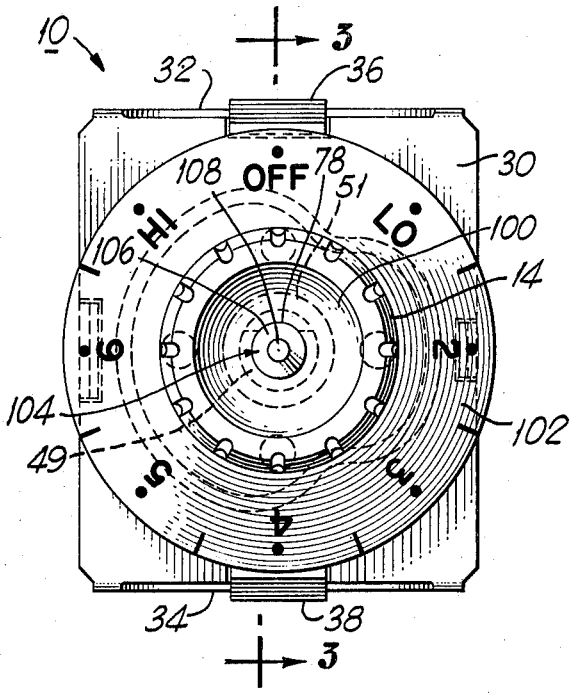
Fig. 2
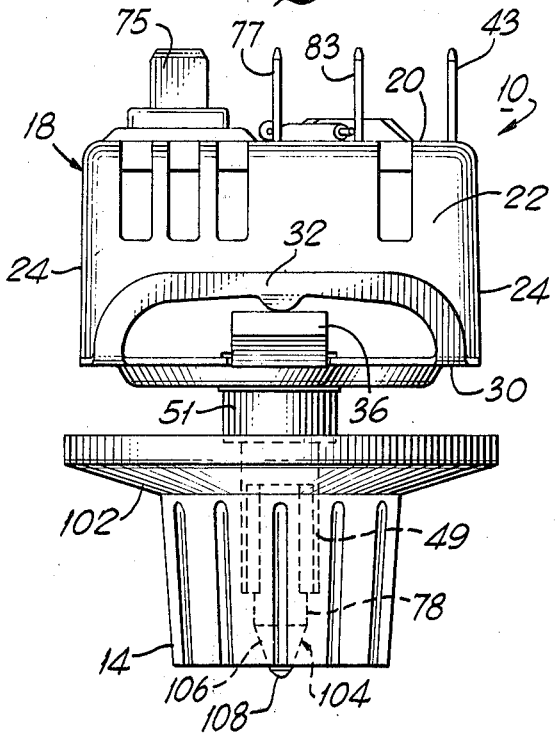
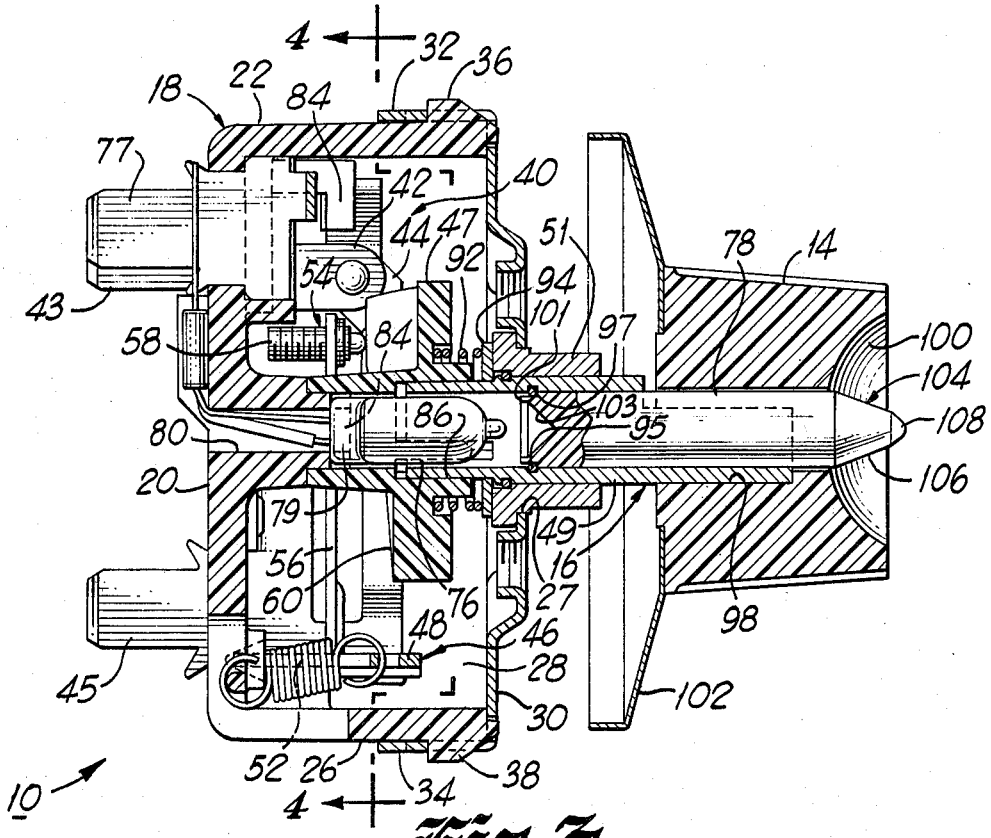
Fig. 3

Fig. 8
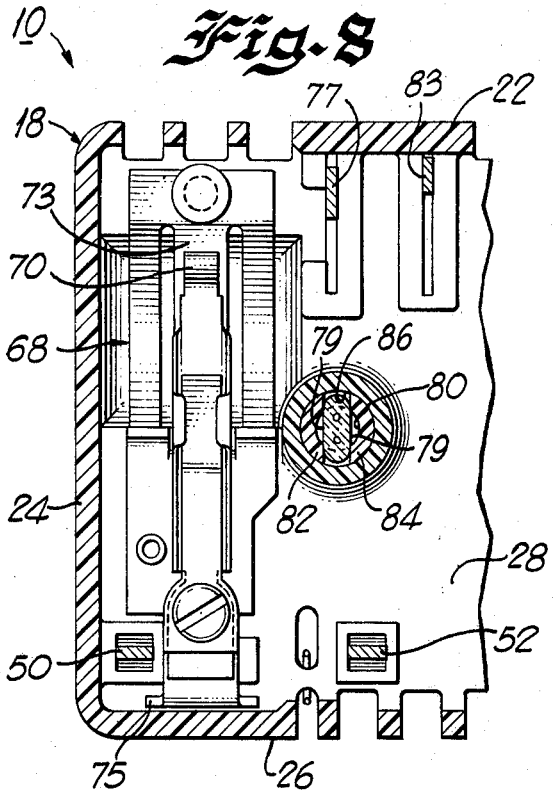
Fig. 9
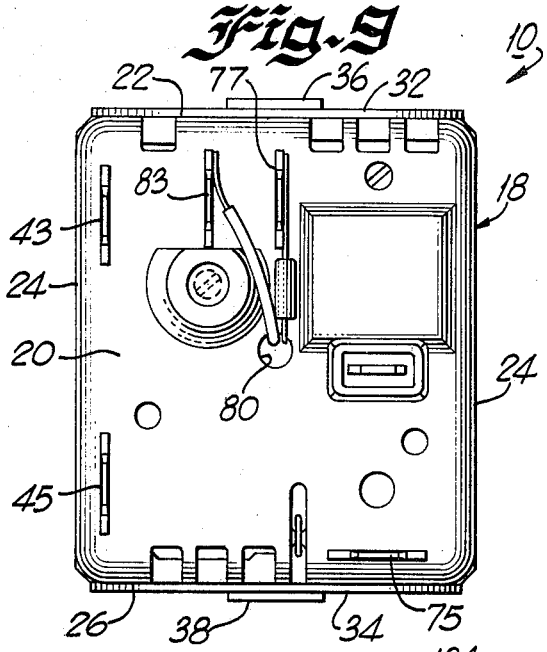
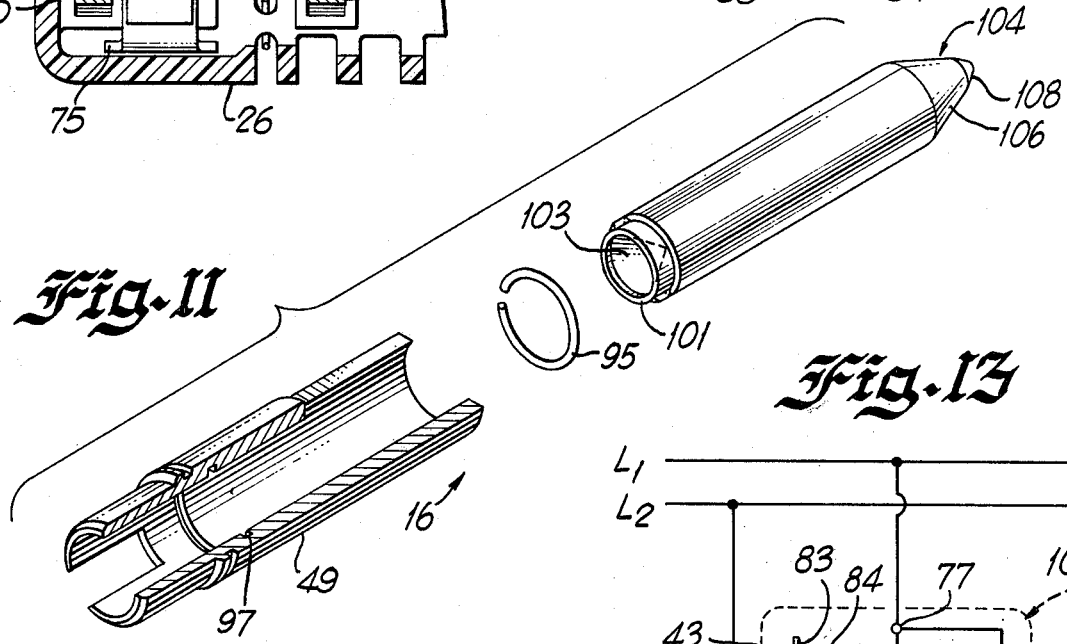
Fig. 11
Fig. 13
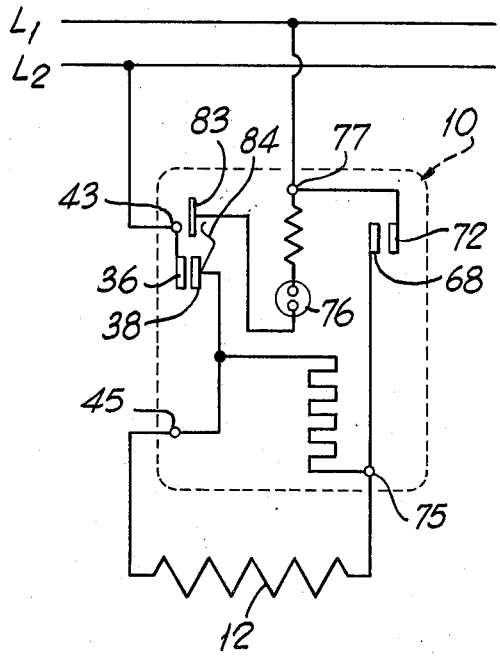
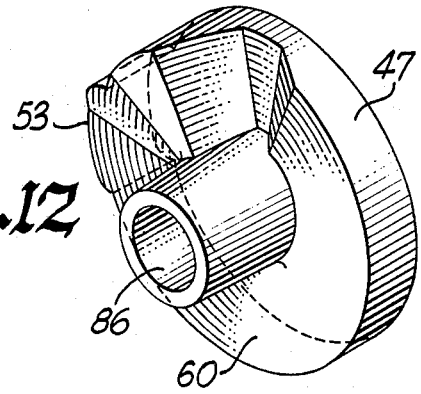
Fig. 12

INFINITE SWITCH AND INDICATOR

BACKGROUND OF THE INVENTION

A. Field of the Invention

The present invention generally relates to a new and improved apparatus for indicating the operative condition of an infinite switch and the heating element connected thereto, and more particularly, to an infinite switch for controlling the on-off condition and temperature of a stove heating element wherein the switch includes a light within the housing of the switch and a light transmission element transmitting the light from the interior to the exterior of the housing.

B. Description of the Prior Art

Present day electric stoves have heating elements that may not change in appearance upon being energized. Thus, the heating element can be at an elevated temperature and yet not appear to be energized, resulting in a hazardous condition. To overcome this problem, many stoves incorporate a light or signal positioned on the exterior of the stove housing. This light is energized upon the energization of one or more heating elements. Often times, these indicating lights or their corresponding lenses are located adjacent the heating element on the smooth surface of the stove housing and extend above the surface. In this location, the light or lens is subject to damage as a result of being struck by pots, pans or the like.

Other types of indicators utilize a lens that is flush with the surface of the stove's housing and adjacent the lamp. The result is decreased side light such that the operator of the stove must be directly above the lens to determine whether the lamp and therefore the heating element is energized. An example of this type of prior art indicator is depicted in U.S. Pat. No. 2,826,680.

One method of overcoming the problem of poor side light is to incorporate the lens in the switch knob or in the housing of the stove and fabricate the lens in the configuration of a hollow housing. The lens extends above the stove or knob surface and one end of the lamp is located within the lens housing providing improved side light. However, the lens and bulb extend outside the surface of the knob or stove and may be easily contacted by an element such as a pot or pan thereby being subject to breakage. An example of this type of prior art indicator is illustrated in U.S. Pat. No. 3,320,393.

SUMMARY OF THE INVENTION

An object of the present invention is to provide a new and improved device for controlling and indicating the energization of a heating element.

Another object of the present invention is to provide a new and improved device for transmitting light from a lamp located within the interior of an infinite switch housing to a point external of the housing while providing maximum side light.

Briefly, the present invention is directed to a new and improved infinite switch including a pilot lamp or light source positioned within the interior of the switch housing, and further including a cover having a central aperture and a hollow spindle extending through the aperture and into the interior of the housing. One end of the spindle is located adjacent the pilot lamp or light source; the other end has attached thereto a knob. The knob has a central aperture through which one end of the hollow spindle extends.

In accordance with an important feature of the present invention, a plastic or similar light transmitting tube is positioned within the hollow spindle with one end extending through the aperture of the knob and the other end positioned adjacent the pilot lamp. The pilot lamp or light source is connected to a circuit such that the lamp will be energized upon energization of the switch and deenergized upon deenergization of the switch, or, in the alternative, the lamp may be connected to a circuit whereupon the lamp is energized upon cyclic energization of the heating element.

BRIEF DESCRIPTION OF THE DRAWINGS

The above and other objects and advantages and novel features of the present invention will become apparent with the following detailed description of a preferred embodiment of the invention illustrated in the accompanying drawings, wherein:

FIG. 1 is an elevational view of an infinite switch including a preferred embodiment of a pilot light assembly constructed in accordance with the principles of the present invention;

FIG. 2 is a plan view of the switch illustrated in FIG. 1;

FIG. 3 is an enlarged, cross-sectional view taken along line 3—3 of FIG. 1;

FIG. 8 is a fragmentary, cross-sectional view taken along line 8—8 of FIG. 7;

FIG. 9 is an end, elevational view of the switch illustrated in FIG. 1;

FIG. 11 is an exploded, partially fragmented view of a portion of the pilot light transmitting assembly of the switch of FIG. 1;

FIG. 12 is an enlarged, perspective view of the cam of the switch of FIG. 1; and FIG. 13 is a schematic representation of the electrical circuit of the switch illustrated in FIG. 1.

DESCRIPTION OF THE PREFERRED EMBODIMENT

Figure 4:
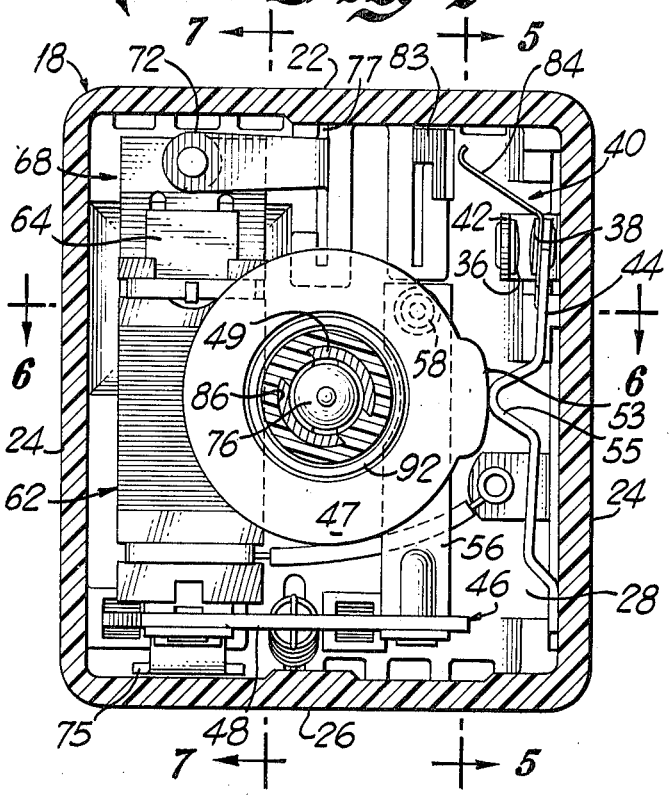
FIG. 4 is a cross-sectional view taken along line 4—4 of FIG. 3.
Figure 5:
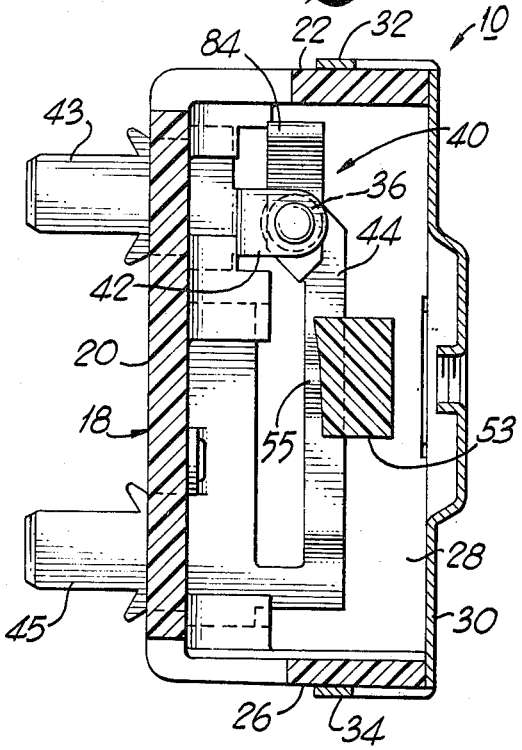
FIG. 5 is a cross-sectional view of the device of the present invention taken along line 5—5 of FIG. 4.

With reference to the drawings, there is illustrated a new and improved infinite switch generally designated as 10 constructed in accordance with the principles of the present invention. As indicated schematically in FIG. 13, the infinite switch 10 may be electrically connected between a power supply and the electric heating element 12 of a cooking unit (not shown) for controlling the energization and temperature of the heating element 12.

The on-off condition of the switch 10 and the temperature level of the heating element 12 are controlled by an operator through rotation of a knob 14 on the switch 10. In addition, in accordance with the present invention, the on-off condition of the switch is indicated on the face or front of the knob by a novel, visual indicator structure generally designated as 16 and described below.

The infinite switch 10 includes a nonconductive housing 18 having back 20, top 22, side 24 and bottom 26 walls (FIG. 3). The housing 18 has an open face 28 (FIG. 10) that allows access to the various elements of the switch 10 contained within housing 18. After assembly of the infinite switch 10, the open face 28 is covered by a cover 30 for protection of the elements of switch 10 from dust and debris. The cover 30 includes two bails 32 and 34 (FIGS. 2 and 3) positioned over lugs 36 and 38 molded on the housing 18 to provide a snap fit of the cover 30 over the open face 28.

The infinite switch 10 performs two switching functions. The first is to control the on-off condition of the switch 10, and the second is to energize in a cyclic manner the heating element 12 thereby maintaining the element 12 at a predetermined temperature level.

For controlling the on-off condition of the switch 10, infinite switch 10 includes a switch assembly generally designated as 40 (FIG. 4). Switch assembly 40 comprises two switch elements or blades 42 and 44 each having an extending blade contact portion 43 and 45, respectively, to which electrical connection is made in any conventional fashion. Switch element 42 is electrically connected to an outside power source such as power line $L_1$(FIG. 13) and switch element 44 is connected to the heating element 12. Consequently, once switch elements 42 and 44 are in contact, the heating element 12 is connected at one end to outside power line $L_1$.

In order to control the contacting and noncontacting positions of switch elements 42 and 44 and thus the on-off condition of the switch 10, infinite switch 10 includes a cam 47 (FIG. 10) mounted upon a spindle or rotor 49 which in turn extends through a bearing 51 within aperture 27 in cover 30 and carries the knob 14. Accordingly, rotation of the knob 14 by an operator imparts rotation to the cam 47.

The cam 47 has a boss 53 on its circumferential surface. Upon rotation of the cam 47 to the off position, the boss 53 abuts cam follower 55 fabricated on spring blade or switch element 44 moving switch elements 42 and 44 out of abutting relationship (FIG. 4) and deenergizing or breaking the circuit between the heating element 12 and the power line $L_1$.

Figure 10:
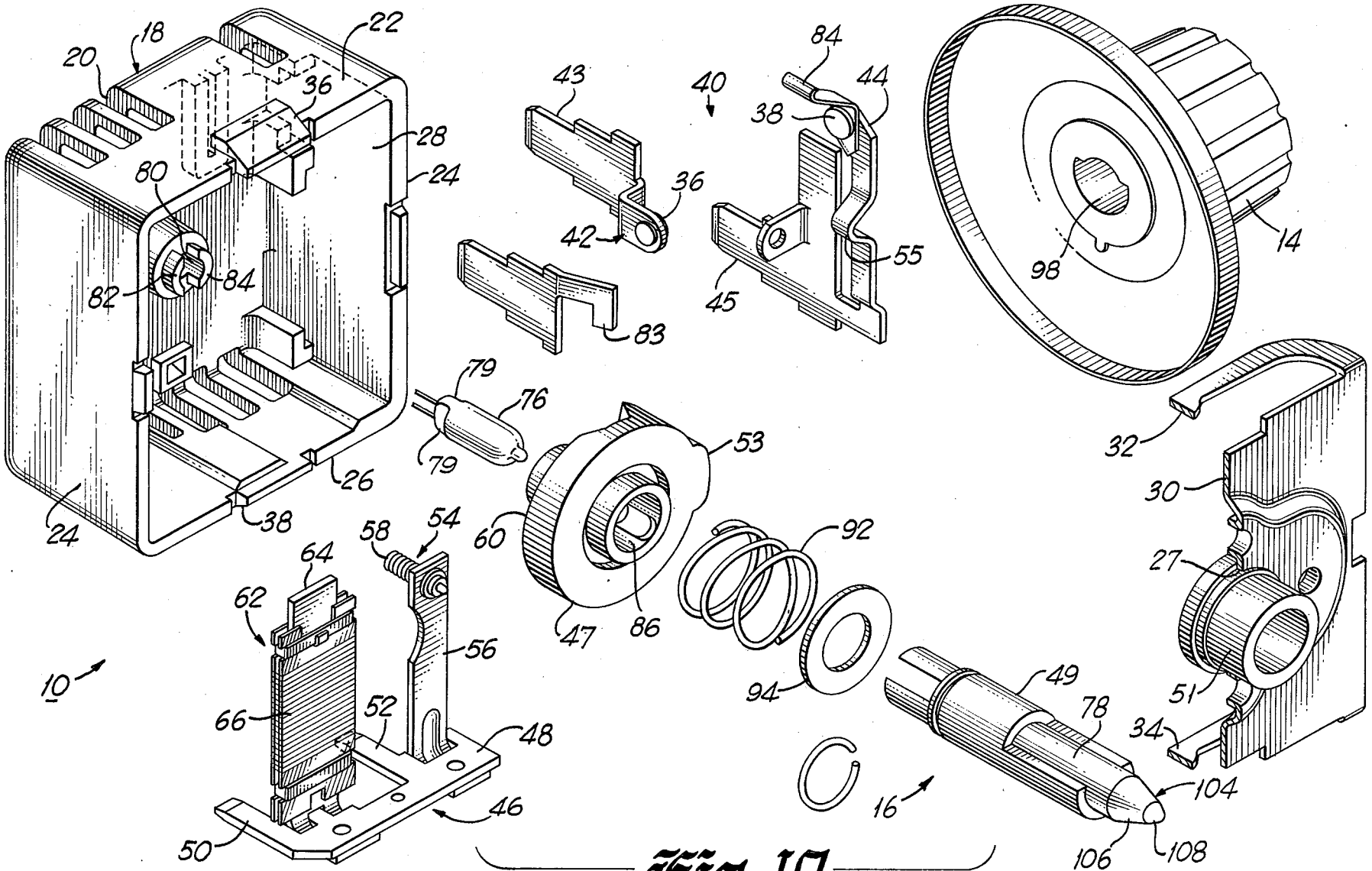
FIG. 10 is an exploded, perspective view of portions of the switch illustrated in FIG. 1.

The second switching function of the infinite switch 10 is control of the temperature level of the heating element 12. This is accomplished primarily by a bimetal assembly indicated generally as 46 (FIG. 10). Assembly 46 includes a bimetal element 64 providing the assembly 46 with the capability of cycling a pair of switches 68 and 72 into and out of electrical contact.

Assembly 46 comprises a support plate 48 including extensions 50 and 52 that are mounted into the back wall 20 of the housing 18 thus mounting the assembly 46 within the infinite switch 10.

Figure 6:
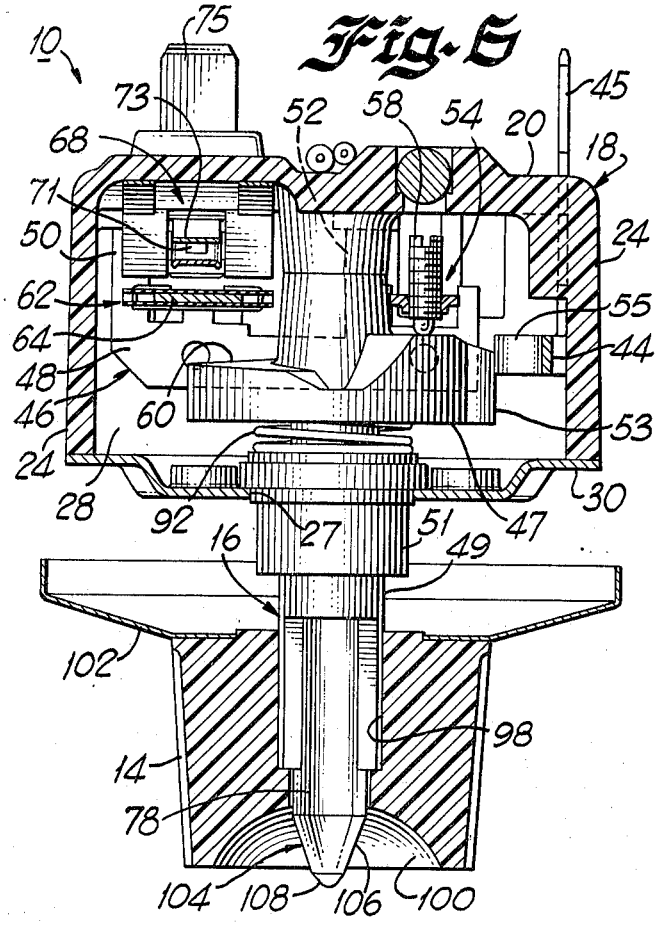
FIG. 6 is a cross-sectional view taken along line 6—6 of FIG. 4.

The assembly 46 also includes a cam follower indicated generally as 54 comprising longitudinal member 56 and an adjustable follower 58. The follower 58 is mounted within the infinite switch 10 in a relationship relative to the cam 47 (FIG. 6) such that the cam follower 58 abuts an inclined surface 60 of cam 40. The inclined surface 60 of cam 47 comprises a gradually inclined path (FIG. 12) such that rotation of cam 47 moves the assembly 46 away from cam 47 and toward the back wall 20 of the housing 18 a variable amount depending upon the position of the cam follower 58 upon surface 60.

Figure 7:
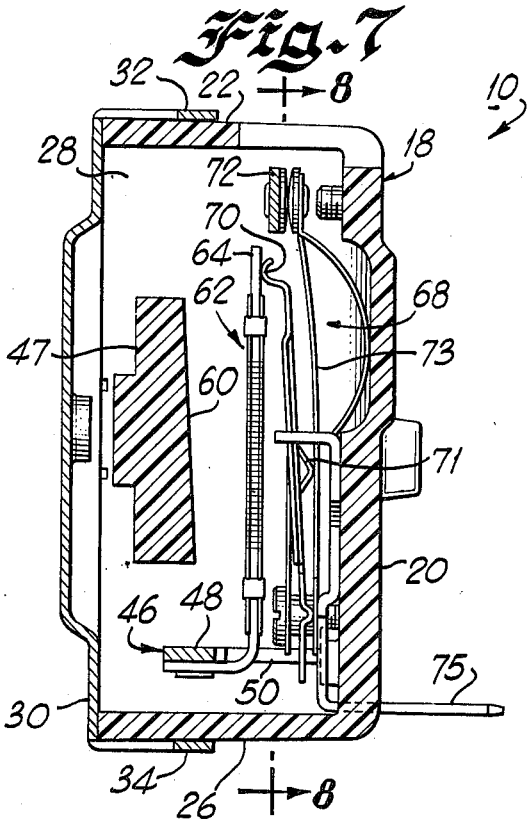
FIG. 7 is a cross-sectional view taken along line 7—7 of FIG. 4.

The importance of the movement of assembly 46 upon rotation of cam 47 is understood when considered with respect to the thermomotive assembly 62 (FIG. 10). The thermomotive assembly 62 includes a bimetal controller 64 enveloped by a heating ribbon or element 66. Bimetal controller 64 is in abutting relationship with the switch member or terminal generally designated as 68 (FIG. 7). Switch member 68 includes a lever 70 that abuts bimetal controller 64. Lever 70 has a boss 71 fabricated thereon that abuts bifurcated spring blade 73. Thus, lever 70 transmits movement of the controller 64 to the member 68. Switch member 68 further includes an extending blade contact 75 to which electrical connection is made in a conventional fashion. Accordingly, upon rotation of cam 47 and the resultant movement imparted to switch assembly 46 through cam follower 58, switch member 68 is moved relative to terminal 72.

The inclined surface or path 60 is graduated at a predetermined inclination, thus rotation of the cam 47 predetermines the duration of the cycle of the energization of the heating element 12 by positioning the assembly 46 relative to the assembly 68. Terminal 72 has a blade extension 77 that is electrically connected to an outside power line $L_2$ (FIG. 13) and switch 68 through blade 75 is electrically connected to heating element 12, thus heating element 12 is cyclically connected between the two outside power lines $L_1$ and $L_2$ (FIG. 13).

Once cam 47 is rotated to a position where cam follower 55 is not abutting boss 53, switch elements 42 and 44 contact each other thereby energizing the infinite switch 10 by connecting the switch 10 with outside power line $L_1$Moreover, rotation of cam 47 also moves cam follower 58 thereby positioning the switch member 68 such that it is in contact with terminal 72 under a predetermined amount of pressure. As heating ribbon 66 heats the bimetal controller 64 in a manner well known in the art, the switch assembly 68 is moved out of abutting relationship with terminal 72 by controller 64 thus breaking the contact of heating element 12 with the outside power line $L_2$ thus deenergizing the heating element 12 and allowing the temperature to decrease to a level determined by the spacing of element 68 and terminal 72. Upon reaching this predetermined level, the bimetal controller 64 has cooled thereby moving to a position such that terminal 72 is again in contact with switch assembly 64 reenergizing heating element 12. This cycle continues until cam 47 is rotated to a position such that boss 53 abuts cam follower 55 deenergizing the infinite switch assembly 10.

In accordance with an important feature of the present invention, there is included a visual indicator assembly generally indicated as 16 (FIG. 10). The function of the indicator assembly 16 is to indicate visually the on-off condition of the infinite switch 10. The indicator assembly 16 comprises a light source or lamp 76 and a light transmitting pipe 78. In a specific embodiment, the pipe 78 may be fabricated from translucent plastic. The lamp 76 is positioned within the housing 18 of the infinite switch 10 and is thereby protected from breakage or damage.

Lamp 76 is mounted in aperture 80 molded in back wall 20. Aperture 80 includes ribs 82 and 84 which abut the bottom, indented portions 79 of lamp 76 thus preventing rotation of the lamp 76 within aperture 80 (FIG. 8). Lamp 76 is electrically connected to outside power line $L_2$ and to terminal 83 (FIG. 13). In the specific embodiment illustrated, lamp 76 is energized upon rotation of cam 47 and movement of boss 53 out of abutment with cam follower 55. Upon rotation of cam 47 in the above-described manner, extension 84 of switch assembly 40 contacts terminal 83 completing the circuit through the lamp 76 from outside power line $L_1$ to outside power line $L_2$. Cam assembly 47 includes a central aperture 86 through which lamp 76 extends in a manner such that rotation of cam 47 does not rotate lamp 76.

In accordance with an important feature of the present invention, light transmitting tube or pipe 78 is mounted within the infinite switch 10 in a manner such that one end of light transmission pipe 78 is adjacent the lamp 76 (FIG. 3). This position is accomplished by mounting the light transmitting pipe 78 within the spindle or rotor 49. The spindle 49 extends into the aperture 86 of cam 47 and surrounds at least a portion of lamp 76. Cover 30 is then positioned over the open face 28 of housing 18. Cover 30 includes a bearing 51 through which the light transmitting pipe 78 and spindle 49 extend. Cam 47 is resiliently held in abutment with the back surface 20 of the housing 18 by spring 92 and washer 94; both are interposed between the face of cam 47 and the back surface of cover 30 (FIG. 3). Pipe 78 is held within spindle 49 by the placement of spring 95 in groove 97 fabricated in spindle 49. In this manner, spring 95 tends to tighten spindle 49 around pipe 78 thereby frictionally retaining pipe 78.

In order to control the position of cam 47 relative to the switch assemblies 44 and 46 of the switch 10 and to allow an operator to control the energization of element 12, a knob 14 is mounted upon spindle 49 by passing spindle 49 and light transmitting pipe 78 through a central aperture 98 of knob 14. The face of the knob 14 includes a central depression 100 into which end 99 of light pipe 78 extends. Depression 100 serves to protect the pipe 78 from damage and is of a sufficiently wide angle to allow easy visibility and increased side light. Moreover, depression 100 may be coated with a reflective material to enhance further its visibility characteristics.

To enhance further the visibility characteristic of the light pipe 78 to allow an observer to ascertain whether the lamp 76 and thus switch 10 is energized, end 101 of the light pipe 78 is fabricated with a hollow, internal cone or conical insert 103. The angular sides of the cone 103 effectively function to bend light rays emitted by lamp 76 causing refraction and reflection of the rays along the length of the light pipe 78 ensuring that a greater portion of the rays entering end 101 are transmitted via the pipe 78 to end 104.

Additionally, at end 104 of light pipe 78 there is fabricated a conical end portion having angular sides 106 and 108. The angular sides 106 cause dispersion of the light rays passing through pipe 78 such that an operator of the infinite switch 10 is able to view the light rays emanating from end 104 up to approximately a 30 degree angle from the longitudinal axis of the light pipe 78.

To enable an operator of the infinite switch 10 to observe light rays emanating from lamp 76 at an angle from approximately 30° up to approximately 90° from the longitudinal axis of the light pipe 78, the end 104 further includes a second conical end portion defined by the sides 108. The sides 108 are at a greater angle to the longitudinal axis of the light pipe 78 than sides 106. In this manner, the light rays traveling through pipe 78 are dispersed at a wider angle such that the operator of infinite switch 10 may observe the light emanating from sides 108 up to approximately a 90° angle from the longitudinal axis of the light pipe 78 if necessary.

To allow the operator to set the desired temperature level of the heating element 12, the face of the knob 14 also includes indicia 102 on the periphery of the face of knob 14 that corresponds to the position of follower 58 upon the inclined surface 60. Rotation of the knob 14 imparts rotation to indicator assembly 16 and consequently to cam 47 thereby engaging switch element 42 and 44 and positioning contact member 68 relative to terminal 72. As previously discussed, by rotating knob 14 the operator energizes infinite switch 10 and the lamp 76, and predetermines the temperature level of heating element 12.

Obviously, many modifications and variations of the present invention are possible in light of the above teachings. For example, an individual skilled in the art could modify the novel switch 10 in a manner well known in the art such that the indicator assembly 16 would indicate when element 12 was energized. Thus, it is to be understood that, within the scope of the appended claims, the invention may be practiced otherwise than as specifically described above.

What is claimed as new and desired to be secured by Letters Patent of the United States is:

1. An infinite switch for controlling the temperature of a stove heating element comprising a housing, a cover on said housing having an aperture, a hollow, rotatable spindle positioned within said housing and extending through said aperture, said spindle being movable between an off position and a range of on positions, a knob mounted on said spindle and the exterior of said housing, said knob including an axial aperture, cam means mounted on said spindle and rotatable therewith, first and second switch contact means disposed within said housing adjacent said cam means, said first switch contact means being movable to an open position by said cam means in said off position and to a closed position in said range of on positions, thermal means for cycling said second contact means between closed and open positions, said cam means being engageable with said second switch contact means for varying the proportion of cycling between open and closed positions, terminal means supported by said housing for connecting said first and second switch contact means in a series circuit including a power source and the heating element, a light source positioned entirely within said housing adjacent said spindle, circuit means electrically connecting said light source to said first switch contact means for energizing said light source upon movement of said first switch contact means to said closed position, and light transmission means positioned within said spindle adjacent said light source and extending along said spindle and through said aperture in said knob, said light transmission means including a translucent member having a first, conical shaped end with sides of a preselected angle, said first end extending outside of said knob for transmitting light from said light source along at least a portion of said spindle within said housing to the exterior of said housing.

2. A switch for controlling a heating element comprising a housing, a cover detachably connected to said housing, an opening in said cover, rotor means positioned in said opening and within said housing for rotation about the center axis of said opening, a cam mounted within said housing and detachably coupled to said rotor means for rotation therewith, said rotor means and said cam having a coaxial bore within which is positioned a light source, circuit means electrically connecting said light source to said heating element for simultaneously energizing said heating element and said light source, light transmission means positioned within said bore of said rotor means and adjacent said light source for conducting light from said light source, said light transmission means comprising a translucent plastic tube having a first end adjacent said light source and a second end extending outside of said housing, and a knob having an aperture coaxial with said bore, said rotor means and said first end of said tube extending into said aperture.

3. A switch as claimed in claim 2 further comprising antirotation means fabricated on said housing allowing said light source to remain stationary upon rotation of said rotor means.

4. An infinite switch as claimed in claim 1 wherein said light transmission means comprises a plastic tube.

5. A switch as claimed in claim 2 wherein said first end of said tube being of a conical configuration with a side fabricated at a preselected angle.

* * * * *